US005804746A

United States Patent [19]

Kersenbrock et al.

[11] Patent Number: 5,804,746

[45] Date of Patent: Sep. 8, 1998

[54] PRETENSIONED SOUNDBOARD FOR STRINGED MUSICAL INSTRUMENTS

[76] Inventors: Keith D. Kersenbrock, 111 S. Third, Lindsborg, Kans. 67456; Walter J. Pickett, 1315 23rd Rd., Kanopolis, Kans. 67454

[21] Appl. No.: 839,588

[22] Filed: Apr. 15, 1997

Related U.S. Application Data

[60] Provisional application No. 60/015,506 Apr. 16, 1996.

[51] Int. Cl. [6] ..... G10D 3/00; G10D 3/02

[52] U.S. Cl. ..... 84/291; 84/294

[58] Field of Search ..... 84/291, 294

[56] References Cited

U.S. PATENT DOCUMENTS

| | | | |
|---|---|---|---|
| 4,640,174 | 2/1987 | Falcone | 84/196 |
| 4,969,381 | 11/1990 | Decker, Jr. et al. | 84/291 |
| 5,461,958 | 10/1995 | Dresdner et al. | 84/267 |
| 5,585,579 | 12/1996 | Ignatius | 84/192 |
| 5,689,074 | 11/1997 | Penridge | 84/294 |

*Primary Examiner*—Michael L. Gellner
*Assistant Examiner*—Daniel Chapik

[57] ABSTRACT

Soundboard material (10) is secured in a tensioning frame (12) and stretched or tensioned. The soundboard material (10) is allowed to stabilize at a predetermined tension. A tension retainer (26) is glued to soundboard material (10). This assembly is then adhered to a stringed musical instrument body.

Because of the effect of tensioning on the soundboard material and the materials used for the soundboard construction, the impedance of the pretensioned soundboard is nearly identical to that of the strings. The means for retaining soundboard tension also serves to isolate the pretensioned soundboard from the rest of the instrument. Thus the transfer of energies from the strings to the pretensioned soundbcard is maximized. There are numerous beneficial results of the process on the overall performance of the musical instrument.

5 Claims, 4 Drawing Sheets

PRETENSIONED SOUNDBOARD FOR STRINGED MUSICAL INSTRUMENTS

BACKGROUND-REFERENCES TO RELATED APPLICATIONS

This invention was granted Provisional Patent status on Apr. 16, 1996. application No. 60/015,506.

BACKGROUND-FIELD OF INVENTION

This invention relates to stringed musical instruments, specifically to an improved soundboard for stringed musical instruments.

BACKGROUND-DISCUSSION OF PRIOR ART

Stringed musical instruments to date suffer from numerous shortcomings:

a) Most exhibit a poor volume output. Thus, when the instrument is played in ensemble, it must be amplified to be heard.

b) Traditionally most fine stringed musical instrument soundboards are made of spruce or other similar woods that have a low specific gravity (density) and high modulus of rupture (a measure of strength), and thus a very high speed of sound as desired in fine traditional instruments. However, these same woods have an exceptionally low cross-grain sheer strength (an indication of the strength of the wood across the grain). Therefore, they are susceptible to damage, drying out, fracturing and splitting. The instruments are very sensitive to extremes in temperature, rapid temperature changes, and sudden fluxes in humidity.

c) Traditional instruments exhibit an unevenness of response over the frequency range of the strings. Most instruments are plagued with "dead spots" or "wolf tones". These are particular frequencies that either respond very poorly to or are much louder than the notes of the other frequencies.

d) Often combinations of wound and unwound strings in various guages are used. These respond with different tonal qualities. The thin unwound strings tend to lack volume and have a thin, nasal quality. The heavier, wound strings are often loud and boomy.

e) If the instrument is to be played with a light touch, a light, flexible top is desired. Aside from the fragile nature of this instrument, the sound tends to "break up" (become distorted) if it is played with vigor. On the other hand, a stiff top manufactured for vigorous playing will not emit a satisfactory volume when played with a light touch.

f) When two or more notes are played simultaneously on the traditional instrument, the sound is often "muddy" (lacking clarity). Generally, the individual notes of the chord can not be discerned out of the mix.

g) Speed of response is the speed at which the instrument emits sound after the strings are set in motion. Most traditional instruments suffer a slow speed of response.

h) The projection of sound from conventional instruments is also limited.

i) The traditional soundboard is not isolated from the rest of the instrument. Energies, in particular the higher frequencies, "spill off" the edge of the soundboard into the back, sides and neck. The woods comprising these parts are critical to the quality of sound. Only the finest tone woods are used. These are usually exotic woods such as ebony and rosewood.

j) The length of time an activated string is audible (sustain) is limited with a traditional soundboard.

Numerous changes have been attempted and patented. Most left the traditional instrument intact with only subtle changes in body style, soundhole size, bracing patterns, etc. None have had a dramatic improvement on the instrument. These "innovations" have left the majority of musicians still desiring better instruments.

OBJECTS AND ADVANTAGES

Accordingly, there are numerous objects and advantages of our invention:

a) A pretensioned soundboard, when incorporated into a guitar, tests as much as 70 decibels louder than the finest guitars.

b) The pretensioned soundboard has a high specific gravity and exceptionally high modulus of rupture. Thus the instrument is much stronger, very staple, and virtually unaffected by high temperatures, and temperature and humidity fluctuations.

c) This soundboard has no need of being "tuned" (physically altered) in order to cancel the "dead spots" and "wolf tones". An even response over the frequency range of all strings is an inherent characteristic of this invention.

d) The tonal qualities of the different guages and types of strings are uniform in nature in the pretensioned soundboard.

e) The pretensioned soundboard is extremely strong, thus able to handle an aggressive touch and not "break up" and yet light and flexible enough to project even when played softly.

f) Each individual note of a chord is clear and articulate in our instrument.

g) As the soundboard material is placed under tension, the speed of sound of that material greatly increases. Thus this instrument possesses an amazingly quick response.

h) The projection of sound from this soundboard is superior to traditional soundboards.

i) This soundboard is isolated from the rest of the instrument by the tension retainer. Thus, in our instrument, the choice of woods for neck, back, and sides is not critical. Domestic woods may be used, eliminating the reliance of exotic wood products.

j) Sustain has been tested to be twice that of traditional stringed instruments.

Further objects and advantages of our invention will become apparent from a consideration of the drawings and ensuing description.

DRAWING FIGURES

REFERENCE NUMERALS IN DRAWINGS

Figure 1:
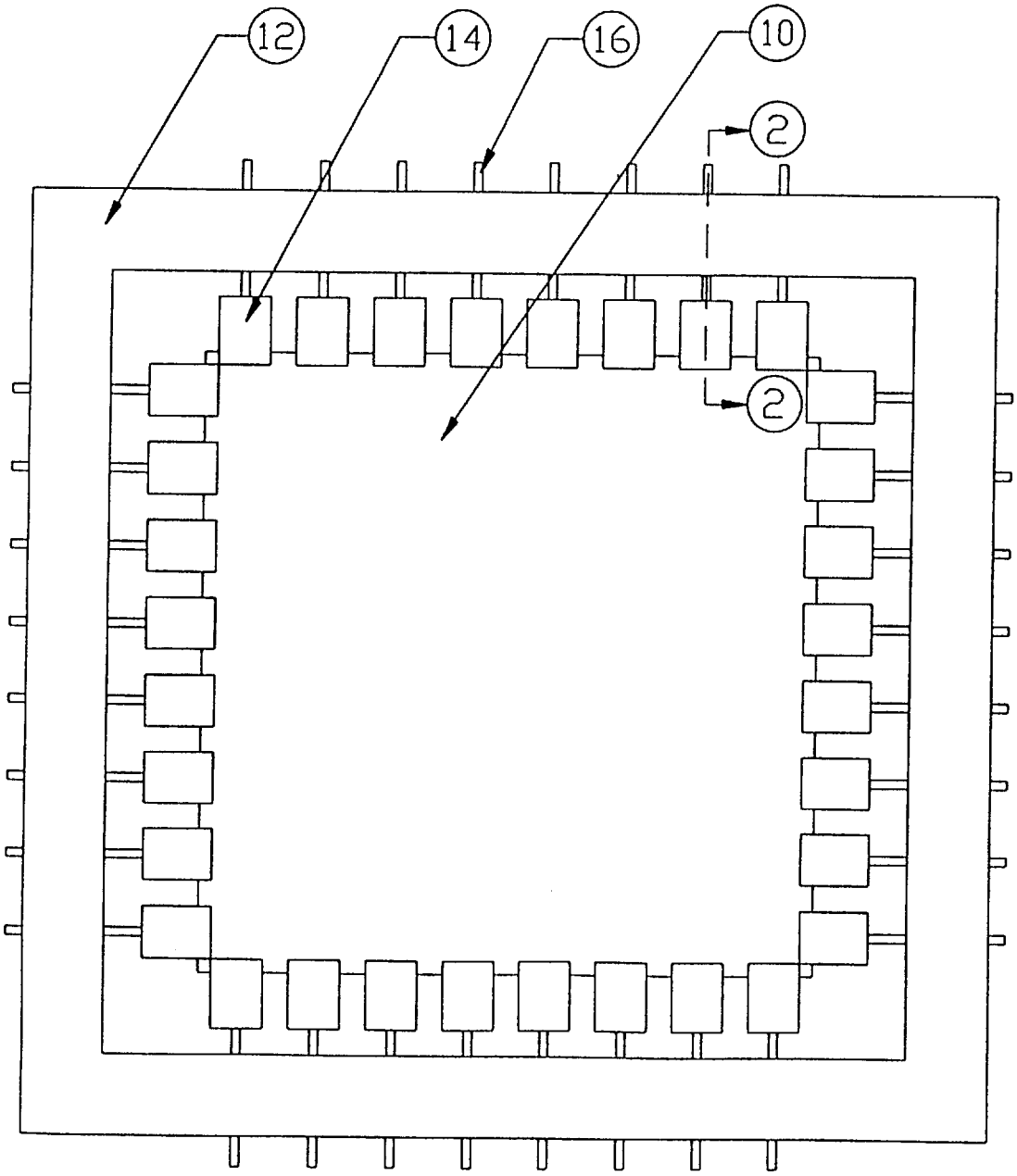
FIG. 1 is a plan view of the tension frame shown prior to tensioning.

10 soundboard material
12 tension frame
14 gluing block
15 shim material
16 threaded bolt
18 spring housing
20 tension spring
22 retaining washer

24 tension nut
26 tension retainer
28 retainer brace
30 instrument sides
32 backing material

SUMMARY

The stringed musical instrument soundboard when placed under tension exhibits qualities that have until now been unobtainable by stringed musical instrument builders. This pretensioned soundboard is applicable to a variety of stringed musical instruments.

DESCRIPTION OF INVENTION

Figure 2:
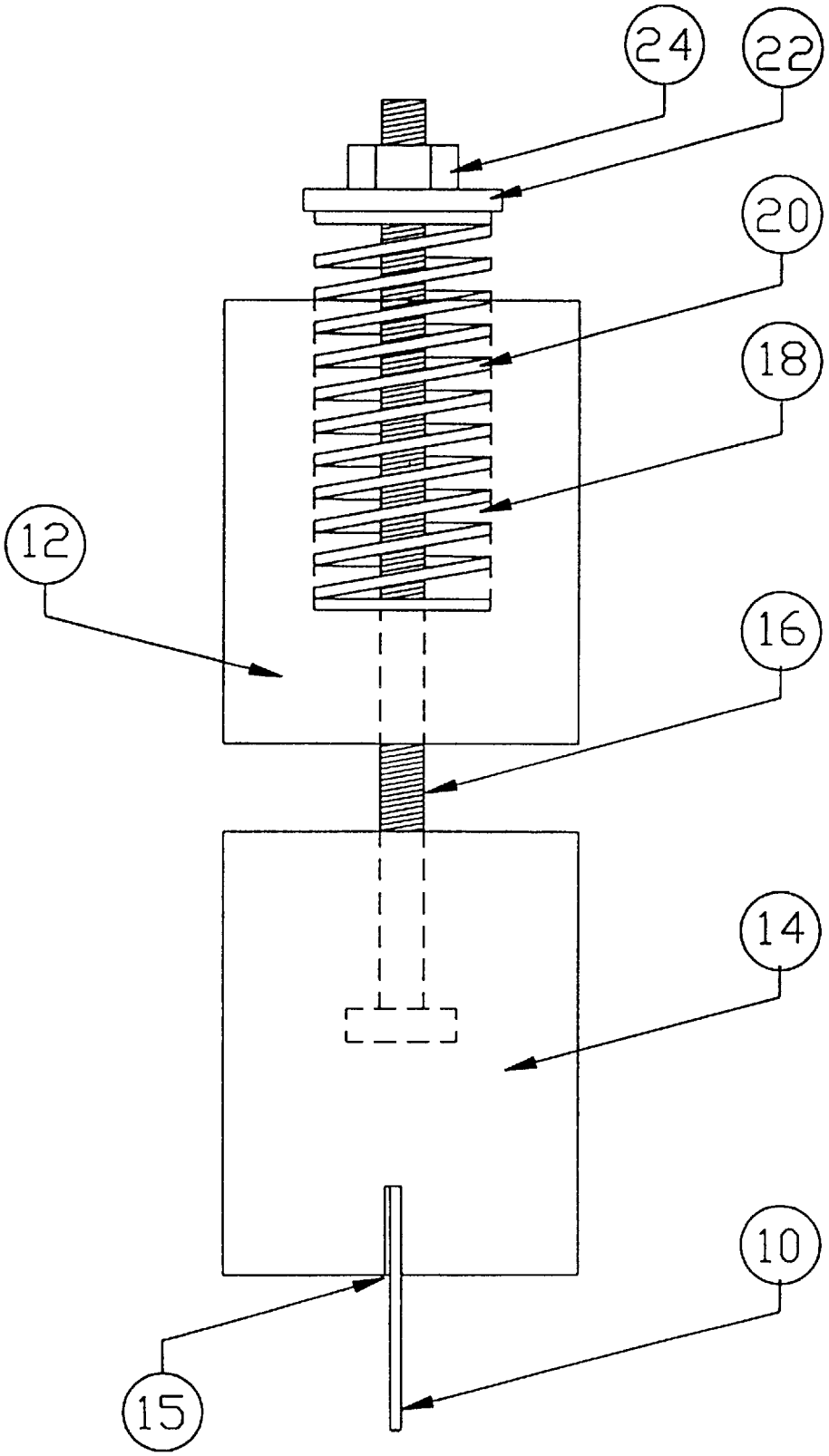
FIG. 2 is a cross-sectional view in detail of the parts indicated by sectioned line 2—2 in FIG. 1, together with parts for tensioning.

A typical embodiment of the tensioning of soundboard material 10 of the present invention is illustrated in FIG. 1 and FIG. 2. Soundboard material 10 is adhered to glue blocks 14. A threaded bolt 16 is anchored in glue blocks 14 and extends through tension frame 12. The typical embodiment of soundboard 10 measures 0.031"×24"×24". A typical tension frame 12 exhibits eight gluing blocks 14 per side. Tension spring 20 is set into spring housing 18. Spring housing 18 is created by a hole that is drilled into tension frame 12. Tension spring 20 is held in place by retaining washer 22 and compressed by tension nut 24.

Figure 3:
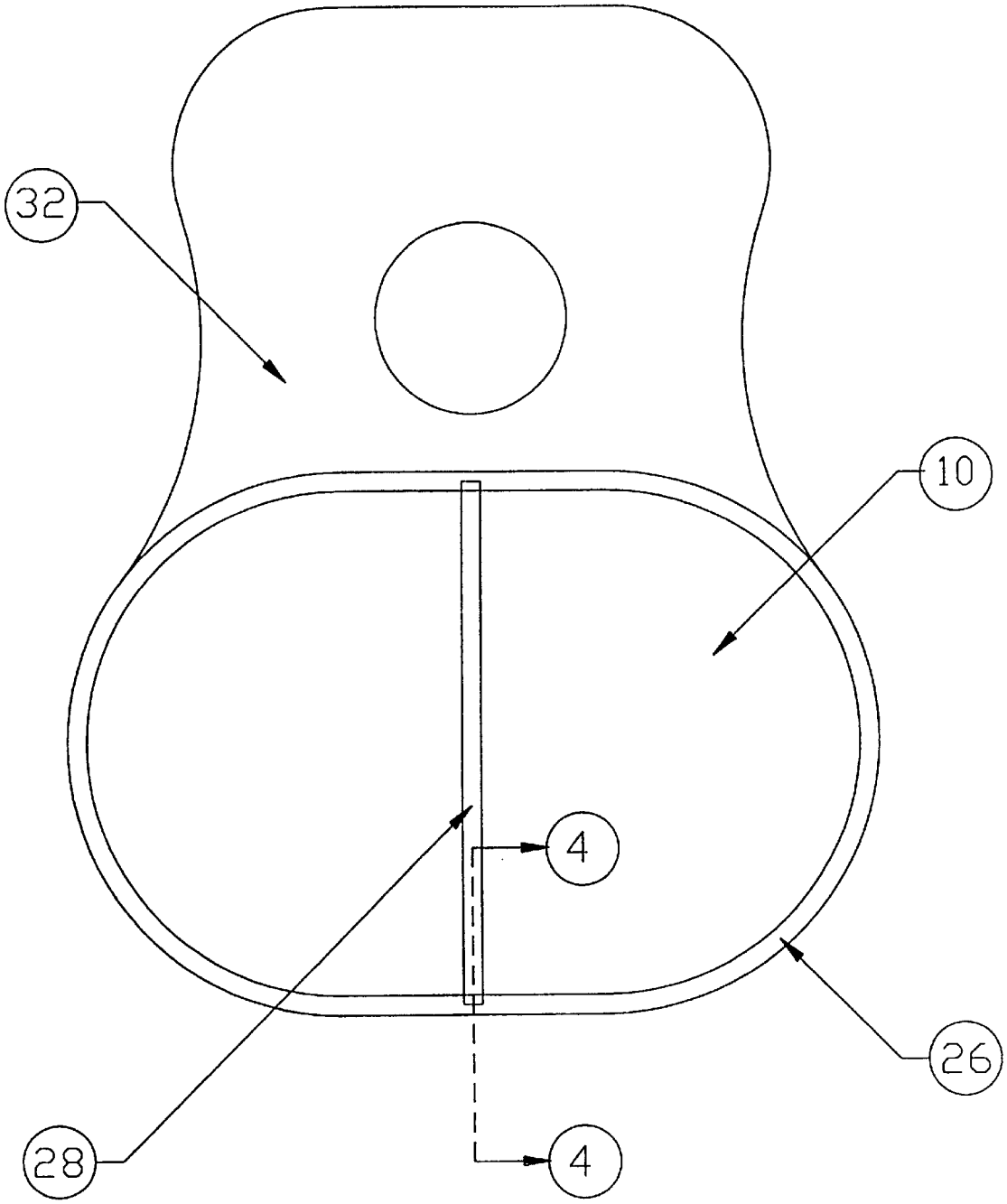
FIG. 3 is a plan view of a pretensioned soundboard in a typical guitar body.
Figure 4:
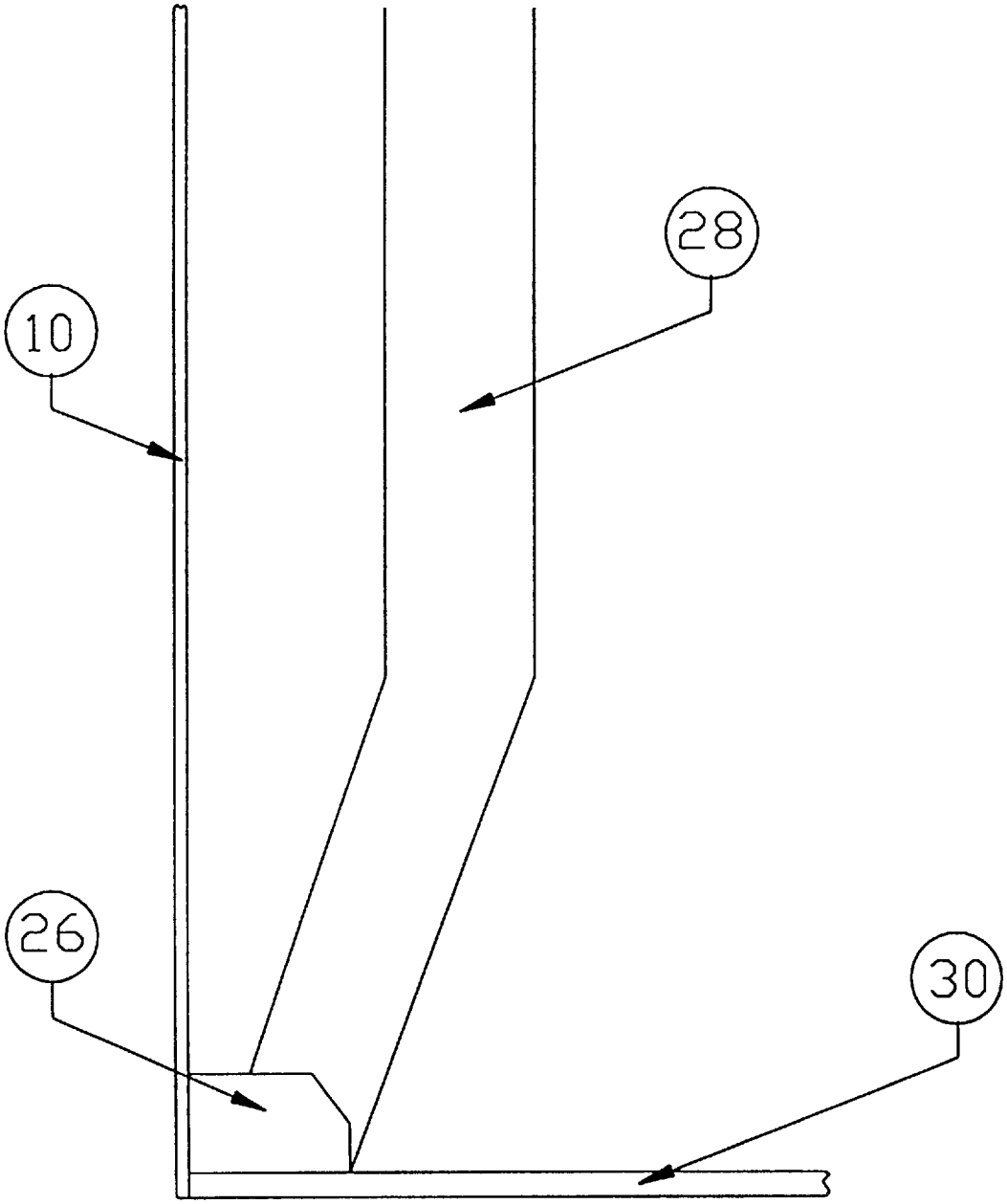
FIG. 4 is a cross-sectional view in detail of the portion indicated by sectioned line 4—4 in FIG. 3.

A typical embodiment of pretensioned soundboard 10 of the present invention is illustrated in FIG. 3 and FIG. 4. Tension retainer 26 is glued to pretensioned soundboard material 10. Retainer brace 28 is glued to tension retainer 26 if oval in nature. Backing material 32 is glued to the area of pretensioned soundboard 10 not inside tension retainer 26.

OPERATION OF INVENTION

Soundboard material 10 is tensioned and prepared for placement in a stringed musical instrument in the following manner:

Gluing blocks 14 are assembled with threaded bolts 16 and are set into tension frame 12. Gluing blocks 14 have a 0.0625" slot cut into one face to receive soundboard material 10. (Refer to FIG. 2.) Shim material 15 of 0.031" 3-ply birch is inserted into said slots together with 0.031" soundboard material. This assembly is then glued into place using cyanoacrylate or other glue.

After the glue has been allowed to cure, tension springs 20, retaining washers 22, and tension nuts 24 are assembled as per FIG. 2. Tension nuts 24 are then slowly brought up to tension, increasing the tension on each tension nut 24 a fraction with each pass around tension frame 12. The preferred embodiment is soundboard material 10 tensioned between 15–20 inch/pounds. Soundboard 10 is allowed several days to stabilize. Tension nuts 24 are retensioned 3–4 times daily to compensate for the stretch in soundboard material 10.

After soundboard material 10 stabilizes, tension retainer 26 made of laminated hard woods, or other suitable materials, is glued onto the back of soundboard material 10. Backing material 32 is glued onto the backside of soundboard material 10 in the areas not held in tension by tension retainer 26. Soundboard material 10 is then cut from tension frame 12.

There are several methods of bracing pretensioned soundboard 10. One involves wood braces. To date, this is not the preferred embodiment of this invention as they tend to imprint (show through) the thin soundboard material 10. Another method is to strengthen the underside of soundboard 10 with several ovals of 0.016" plywood. Each successive oval is smaller in circumference than the previous one. Regardless of the bracing method, the outer perimeter of soundboard 10, as defined by tension retainer 26, should remain free of any bracing materials to allow for as much flexibility as possible.

THEORY OF OPERATION

While we believe the following theories of operation to be accurate, we do not wish to be bound by them.

There are several goals in pretensioned soundboard construction. One is to enable the soundboard to move as a speaker cone and thus duplicate the sound of the strings. The second is to reduce the mass of the soundboard while retaining the strength. As these goals are acheived, most of the shortcomings of the traditional stringed musical instrument are eliminated.

In response to string vibrations, standing waves are set up within the traditional soundboard. Thus, the listener does not hear the strings, as is often assumed, but rather the sympathetic vibrations of the wood itself. Due to the dissimilar qualities of the strings and the wood, the traditional soundboard is not a true reflection of the vibrations of the strings. Whereas, in a pretensioned soundboard, the material moves as a speaker cone, simply mimicking the vibrations of the strings.

The pretensioned soundboard and the strings, when tuned to pitch, are impedance matched. In this context, impedance is defined as the ratio of the tension to the mass of the given material. The impedance of the traditional soundboard is radically different from the impedance of the strings. However, the impedance of the pretensioned soundboard is almost identical to that of the strings. The closer the similarity in impedance, the more economical the transfer of energy from the strings to the soundboard.

Another goal of pretensioned soundboard construction is to try to minimize the "spill over" of energy from the top into the sides, back, and neck of the stringed musical instrument. This is accomplished by two means: increasing the stiffness and increasing the mass around the outer Edge of the soundboard. Both stiffness and mass reflect energy back into the soundboard. The purpose of the tension retainer is not only to stabilize the tension of the top but also to add said stiffness and mass. Thus, the soundboard is isolated from the rest of the instrument.

Accordingly, pretensioned soundboard construction may make use of local domestic wood species without any effect of the quality of sound. Our instrument is thus cheaper to build and is no longer reliant on exotic wood products.

CONCLUSIONS, RAMIFICATIONS, AND SCOPE OF INVENTION

Thus, it will be evident to the reader that the pretensioned soundboard is a much desired advancement of the stringed musical instrument soundboard. This is a true innovation that is immediately evident to even the non-musician.

While the above description contains many specificities, these should not be construed as limitations on the scope of the invention, but rather as examples of the preferred embodiment thereof. Many other variations are possible. For example, the pretensioned soundboard may make use of any number of materials, glues, and woods. Many different bracing patterns may be used as well.

The pretensioned soundboard is applicable to a variety of stringed musical instruments selected from a group comprising, but not limited to: mandolins, violins, guitars, basses, lutes, dulcimers, and harps. There are also various devices that could be used for tensioning the soundboard material and also for retaining the tension of the soundboard after removal from the tensioning apparatus.

Accordingly, the scope of the invention should not be determined by the embodiments illustrated, but rather by the appended claims and their legal equilavents.

We claim:

1. A stringed musical instrument comprising:

a) a body on which strings are suspended and tensioned, and b) a pretensioned soundboard to amplify string vibrations, and c) a means for affixing said pretensioned soundboard to said body, and d) in combination, said pretensioned soundboard and a means for permanently retaining tension in said pretensioned soundboard.

2. The stringed musical instrument as described in claim 1 wherein said body is selected from the group comprising mandolins, violins, guitars, basses, lutes, dulcimers, and harps.

3. The stringed musical instrument as described in claim 1 wherein a soundboard material used to construct said pretensioned soundboard is selected from the group of materials comprising woods, plywoods, and composits.

4. The stringed musical instrument as described in claim 1 wherein a means for permanently retaining tension in said pretensioned soundboard is selected from the group comprising a tension retainer, and a tension retainer and retainer brace.

5. A method for retaining the tension of a pretensioned soundboard material comprising the steps of:

a) permanently fixing tension in said soundboard by adhering a rigid tension retainer to said pretensioned soundboard material, and b) adhering a predetermined number of braces, if necessary, to said rigid tension retainer, and c) Adhering the entire assembly to said stringed musical instrument body; whereby said pretensioned soundboard will permanently retain an even tension.

* * * * *